United States Patent [19]

Hauser et al.

[11] 4,130,436

[45] Dec. 19, 1978

[54] PROCESS FOR RECLAIMING FOUNDRY SAND WASTES

[75] Inventors: Karl V. Hauser, Ann Arbor; Fred Mencenberg, Taylor, both of Mich.

[73] Assignee: Edw. C. Levy Co., Detroit, Mich.

[21] Appl. No.: 796,018

[22] Filed: May 11, 1977

[51] Int. Cl.[2] ..... B28B 7/34

[52] U.S. Cl. ..... 106/38.9; 134/2; 164/5; 264/37

[58] Field of Search ..... 106/38.9; 134/2; 164/5; 264/37

[56] References Cited

U.S. PATENT DOCUMENTS

| | | | |
|---|---|---|---|
| 2,478,461 | 8/1949 | Connolly | 164/5 |
| 3,029,484 | 4/1962 | Kutny | 134/2 |

FOREIGN PATENT DOCUMENTS

| | | | |
|---|---|---|---|
| 2252217 | 5/1974 | Fed. Rep. of Germany | 164/5 |

*Primary Examiner*—Lorenzo B. Hayes

*Attorney, Agent, or Firm*—Harness, Dickey & Pierce

[57] ABSTRACT

A process for treating waste foundry core and/or molding sand in a manner which upgrades these scrap streams to new sand quality for entry at the core making point. The process consists of incrementally heating the sand as required up to temperatures in the 1800° to 2500° F range, followed by cooling. The degree of heating is chosen to achieve a desired lowering of acid demand value (ADV) from that which would result from heating only to conventional high temperatures, about 1500° F. Lowering of ADV reduces the variability which would otherwise be introduced into a mixture of new and recycled sand for cores.

Heating waste molding sand to the temperatures contemplated by the method of this invention also causes clay additives to fuse, become non-absorptive and thus eliminating the need for mechanical attrition which would otherwise be needed to remove the clay so that it would not absorb high quantities of resin in the core making process. The inventive method also burns off resins from the sand being treated in a manner which eliminates environmental pollution.

4 Claims, No Drawings

PROCESS FOR RECLAIMING FOUNDRY SAND WASTES

BACKGROUND OF THE INVENTION

1. Field of the Invention

The invention relates to the treatment of foundry wastes, particularly core and molding sand, so as to reclaim this discarded sand for new core manufacture in the foundry.

2. Description of the Prior Art

Practically all new foundry sand input is used to make cores, which are bonded constructions placed in molds to provide casting voids. The core mold consists of sand bonded with special additives including organic binders. A solidified casting is removed from the mold by vibration which breaks down the sand mold as well as some of the core, the latter also being partially disintegrated by the heat from the mold and metal. The disintegrated core sand enters the molding sand system which is recycled many times, but an equivalent quantity is displaced and must be discarded. Unbroken cores as well as core scrap produced in the core making and curing steps are also discarded. Disposal of this scrap creates both economic and ecological problems and it is therefore desirable to upgrade and reclaim these scrap streams to new sand quality for entry at the core making point.

Problems in reclamation of discarded sand involve both quality level and uniformity. Representative of prior methods are those disclosed in Connolly U.S. Pat. No. 2,478,461, Christensen U.S. Pat. No. 2,420,392, Will U.S. Pat. No. 2,783,511, and Muller U.S. Pat. No. 2,835,941. The Connolly patent discusses the reclaiming of foundry sand by heating or roasting treatment which causes the carbonaceous material to be burned away. The temperatures discussed in this patent are up to 1200° to 1500° F. The other patents describe different reclaiming treatments having various deficiencies with the present invention overcomes. Other prior patents pertinent to the treatment of foundry sand by methods different than that of the present invention are Norton U.S. Pat. No. 2,041,721, Poulsen U.S. Pat. No. 1,052,514 and Zifferer U.S. Pat. No. 3,683,995. None of the above mentioned patents disclose the heat treating method described in the claims in this application with its attendant advantages.

BRIEF SUMMARY OF THE INVENTION

It is an object of the present invention to provide a novel and improved method for reclaiming foundry sand wastes which results in high quality sand of such uniformity as to be acceptable for entry at the core making point.

It is another object of the invention to provide an improved method of this nature which is capable of reducing acid demand value (ADV) of the reclaimed sand to a value making it compatible with new sand with which it is mixed for core manufacture, thus reducing the variability of the mixture in reacting with the catalyst used in making new cores.

It is a further object to provide a novel and improved method of this character which eliminates the need for mechanical attrition of clay binders in waste foundry molding sand, which clay would otherwise absorb high amounts of resin in the core making process and thus weaken the resulting core.

Briefly, the method of this invention for reclamation of foundry sand wastes comprises the steps of (a) heating the sand to a temperature in the range of 1400° to 1600° F. so as to burn off resins and cause any calcium and magnesium carbonates to decompose to calcium oxide and magnesium oxide in the waste core sand and burn off carbon additives in the waste molding sand; (b) continuing to heat the sand to a temperature of between 1800° to 2200° F. at which temperature clay additives in the waste molding sand fuse onto the surface of the sand and become non-absorptive; (c) optional further heating the sand to the 2200° to 2500° F. range so as to cause collapse of the microcrystalline structure of said calcium oxide and magnesium oxide to thus lower their solubility. As a further step in the method, if reduction of ADV to zero is required, the temperature of the sand will be increased toward 2500° F. causing the calcium oxide and magnesium oxide to react chemically with available clays to form aluminates and silicates and form, by melting, an integral coating therewith on the sand grains. The final step in the process will be cooling of the sand followed by screening and classifying in the manner conventional with new natural sand for foundry use.

DESCRIPTION OF THE PREFERRED EMBODIMENTS

The process of this invention will be described first with respect to waste foundry core sand, then waste molding sand and finally with respect to a mixture of these two sands which is the nature of most foundry waste sand.

Waste Foundry Core Sand

This sand is bonded with either sodium silicate or organic resin binders. Binders of the former type are not amenable to treatment by the method of this invention. Sand with organic resin binders is first incinerated to about 1500° F. to burn off the binder, in a manner similar to that described in the aforesaid Connolly patent. However, during this process calcium and magnesium carbonates, found in small amounts in natural sand from which the cores were made, decompose and are calcined to calcium oxide and magnesium oxide which are more chemically active than the original carbonates. This produces a product with an abnormally high "acid demand". In foundry terminology this is called an increase in acid demand value (ADV). If the heating stops at this point, the decomposition products will cause problems in catalyst control of the resin setting times during reuse of the sand. The catalyst used in making cores from the recycled sand will react in a different way than with new sand. Since cores are normally made from a mixture of new and recycled sand, the varability thus produced into the mixture is intolerable.

An unacceptable increase in ADV of recycled sand can be reduced in accordance with the present invention by further heating of the core sand to the 2200° to 2500° F. range. At these increased temperatures, the calcium oxide and magnesium oxide formed at the lower temperatures will first melt, assuming "hard burned" (a term meaning collapse of the microcrystalline structure) or less reactive forms which have lower solubility and thus markedly lower ADV. As the temperature increases toward 2500° F., these compounds react chemically with the sand grain surface to form aluminates and silicates in a manner similar to the reaction which occurs in the manufacture of cement. This will reduce ADV to zero or near zero and the aluminates and silicates will form an integral coating on the sand grains. The sand would then be cooled.

It should be noted with respect to core sand treated in this manner that because this sand has no clays which would react with calcium oxide and magnesium oxide at lower temperatures than will the sand surface, ADV cannot be lowered without achieving relatively a high temperature level. It would therefore appear desirable to process core sand jointly with mold sand as described below, unless sand with a low ADV is used as the original raw material.

Waste Foundry Molding Sand

This sand is a product which includes both clay binders and a fine carbon additive, both of which must be removed or deactivated if the recycled sand is to be placed in a condition suitable for reuse in core making. Otherwise, the carbon and clay additives would cause weakness in a core due to poor adhesion of the resin to the sand. The clay binder would also absorb an excessive amount of resin in the core making process, which results in weakening of the core and is a very costly problem. In addition, this waste foundry molding sand has fine sand resulting from cracking of sand grains during multiple reuse in the molding operations.

According to the invention, waste foundry molding sand can be upgraded for recycling by first heating the sand with air available to burn off the carbon additives at a temperature of 1400° to 1600° F. in a manner already well known in the industry. This heating step can also weaken the bond between the clay and sand grains. However, if the recycling process is stopped at this point the result is inadequate in several ways. The acid demand problem described with respect to the core sand would still arise. Secondly, the clay would still have to be removed, for example by abrasion, in order that it not absorb high quantities of resin in the core making process and thus weaken the core.

Thus, as a second step, the invention contemplates continuing to heat the waste foundry molding sand to a temperature range from 1800° to 2200° F. In this temperature range, varying somewhat with the type of clay used, the clay additives fuse onto the surface of the sand, becoming an integral part of the sand grain and thus become nonabsorptive with respect to the resin which will be added later during the core making process.

As a third step in the method of this invention, if the ADV after the second step is still too high, heating of the sand will be continued into the range of 2200° to 2500° F. In this range, calcium oxide and magnesium oxide which had been formed at the lower temperatures, in the manner described above, will first melt, becoming hard burned, less reactive forms which have markedly lower ADV, and will then chemically react with the fused clay and the sand itself, forming aluminates and silicates to further lower the ADV, and forming an integral coating on the sand grains. The final temperature can be selected to achieve the described lowering of ADV. The sand would then be cooled.

Overheating could cause stress cracking and fracture of the sand grains themselves. This could happen at 2400° F. or above, depending on sand quality and rates of heating and cooling.

Mixed Core Sand and Molding Sand

Most foundries waste sand of both types in varying proportions. A preferred method for mixed sands is as follows:

1. Proceed with treatment of the waste molding sand by heating with air available to burn off carbon additives in the range of 1400° to 1600° F., as described above.

2. The next step is to inject core sand, crushed if necessary to achieve a fast reaction, into the hot molding sand, with an excess of air. This burns out new resins in a manner which recovers the fuel values of the burned resins, resulting in energy saving. Secondly, the resin will be burned off at a temperature high enough to insure complete incineration; that is, no unburned organics will be emitted into the atmosphere which could pollute the environment. It should be noted that this is a potential problem with conventional core sand in incineration systems such as that described in the Connolly patent.

3. As a third step in the treatment of the mixed core and molding sand, the heating would be completed at incremental temperatures as described above with respect to the treatment of waste foundry molding sand, that is, first to temperature range of 1800° to 2200° F. and then, if desired, to a range of 2200° to 2500° F. The sand mixture would then be cooled.

The equipment for performing the above described method, either with respect to molding sand, core sand, or mixtures, could be a rotary kiln, fluid bed calciner or hearth type roaster, all substantially as now manufactured for use in other fields of mineralogical processing.

Final product preparation of recycled core sand, molding sand or a mixture as set forth above would be similar to that, for new natural sand for foundry use. The cooled product would be screened and classified to remove oversize and undersize grains and achieve the correct gradation for satisfactory core manufacture. If some melting together of particles has taken place, this will require crushing of agglomerates.

The following table represents data from tests which compare the treatment method of this invention with other methods for waste foundry core sand, molding sand and a mixture of core and molding sand. The table shows, for each type of material, and for different maximum temperatures treatments of that material for specified times, the resultant change in acid demand value of the material as well as its sand surface characteristics:

Table 1

| Material | Temperature, ° F | Time At Temperature | ADV | Sand Surface Characteristics |
|---|---|---|---|---|
| Core Sand | No treatment | — | 28 | Resin coated |
| | 1400 | — | 46 | > Resin burned off, |
| | 1800 | — | 55 | > grains clear |
| | 2000 | 90 min. | 89 | White-gray color |
| | 2360 | 12 hr. | 15 | |
| | 2490 | 1 hr. | 18.3 | < Clean, milky color, |
| | 2260–2490 | 13 hr. | 8 | < stress fractured |
| Molding Sand | 1600 | — | 36 | Gray, clay coating |

Table 1-continued

| Material | Temperature, ° F | Time At Temperature | ADV | Sand Surface Characteristics |
|---|---|---|---|---|
| | 1970 | 1 hr. | 26 | < Clear, clay fused without flowing |
| | 2200 | 15 min. | 27.3 | > Clear, clay fused and invisible |
| | 2300 | 30 min. | 5 | |
| 22% Core, 78% Mold | 2160 | 10 min. | 33.1 | |
| | 2200 | 45 min. | 23.6 | < Red tint, clear grain fused clay |
| | 2230 | 1 hr. | 19 | |
| | 2300 | 25 min. | 14.0 | |
| | 2320 | 30 min. | 9.7 | Clear, clay fused and invisible |
| | 2400 | — | 7 | Clean, transparent but 20–40% stress fractures |

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. A method for reclaiming waste foundry molding sand having carbon and clay additives, comprising the steps of heating said sand to a temperature range of 1400° to 1600° F. with air available so as to burn off the carbon additives, continuing to heat the sand to a temperature range of 1800° to 2200° F., and treating the sand in that temperature range for a specified time with a resultant change in sand surface characteristics in that the clay additives fuse onto the surface of the sand and become nonabsorptive, and then cooling the sand.

2. A method according to claim 1 provided with a further heating step, between the last mentioned heating step and the cooling step, of heating the sand to the range of 2200° to 2500° F. so as to hard burn calcium oxide and magnesium oxide created during the previous heating steps by the calcining of calcium and magnesium carbonates and cause the calcium oxide and magnesium oxide to react chemically with the fused clay and the sand itself so as to form silicates.

3. A method for reclaiming a mixture of waste foundry core sand and molding sand, the core sand having an organic resin binder and the molding sand having carbon and clay additives, comprising the steps of heating the molding sand with air available to a temperature of 1400° to 1600° F. so as to burn off the carbon additives, injecting the core sand into the hot molding sand with an excess of air so as to burn out the resins in the core sand, continuing to heat the mixture to a range of 1800° to 2200° F., and treating the sand in that temperature range for a specified time with a resultant change in sand surface characteristics in that the clay additives fuse onto the surface of the sand and become nonabsorptive, and cooling the mixture.

4. A method according to claim 3, provided with the further step, between the last heating step and the cooling step, of continuing to heat the sand mixture up to the range of 2200° to 2500° F. so as to hard burn calcium oxide and magnesium oxide previously formed by calcining of calcium and magnesium carbonates contained in the sand, said last mentioned heating step being carried out sufficiently to cause said hard burned calcium oxide and magnesium oxide to react chemically with the fused clay and the sand itself to form silicate.

* * * * *